US012325990B1

(12) United States Patent
Feliciano

(10) Patent No.: US 12,325,990 B1
(45) Date of Patent: Jun. 10, 2025

(54) PROTECTIVE COVER FOR WALL MOUNTED TOILET FLUSH SENSORS

(71) Applicant: Francisco Feliciano, Polk City, FL (US)

(72) Inventor: Francisco Feliciano, Polk City, FL (US)

( * ) Notice: Subject to any disclaimer, the term of this patent is extended or adjusted under 35 U.S.C. 154(b) by 173 days.

(21) Appl. No.: 18/095,293

(22) Filed: Jan. 10, 2023

(51) Int. Cl.
*E03D 5/10* (2006.01)

(52) U.S. Cl.
CPC ..... *E03D 5/105* (2013.01)

(58) Field of Classification Search
CPC ..... E03D 5/105
See application file for complete search history.

(56) References Cited

U.S. PATENT DOCUMENTS 4,309,781 A * 1/1982 Lissau ..... E03D 5/10 4/304
5,062,453 A * 11/1991 Saadi ..... E03D 3/08 4/304
5,313,673 A * 5/1994 Saadi ..... E03D 5/105 4/406
5,937,528 A * 8/1999 Shijo ..... G01C 9/06 33/366.21
7,674,976 B2 3/2010 Eastin
10,516,240 B1 12/2019 Insalaco

* cited by examiner

*Primary Examiner* — James N Smalley

(74) *Attorney, Agent, or Firm* — Sanchelima & Associates, P.A.; Jesus Sanchelima; Christian Sanchelima

(57) ABSTRACT

A protective cover for wall mounted toilet flush sensors including a cover assembly, a fastening assembly and an adhesive assembly. The cover assembly includes a cover having at least two openings in a central portion thereof. The fastening assembly includes fasteners and the adhesive assembly includes an adhesive member. The adhesive member is a double-sided adhesive used to adhere said cover to a front wall of a flush sensor. The fasteners are used to fix said cover between an external cover and said flush sensor. The external cover has a sensor opening. Said cover prevents depressing said sensor by covering said sensor opening.

1 Claim, 4 Drawing Sheets

PROTECTIVE COVER FOR WALL MOUNTED TOILET FLUSH SENSORS

BACKGROUND OF THE INVENTION

1. Field of the Invention

The present invention relates to a protective cover for wall mounted toilet flush sensors and, more particularly, to a cover for wall mounted toilet flush sensors that protects the toilet flush sensor when pushed.

2. Description of the Related Art

Several designs for protective covers have been designed in the past. None of them, however, include a transparent protective cover suitable to be inserted between the external cover of a wall mounted toilet flush sensor and the sensor.

Applicant believes that a related reference corresponds to U.S. Pat. No. 7,674,976 issued for a paintable wall plate with a transparent outer plate cover assembly. Applicant believes that another related reference corresponds to U.S. Pat. No. 10,516,240 issued for an outlet wall cover that is used to conceal the outlet. None of these references, however, teach of a protective cover for wall mounted toilet flush sensors that is comprised of a transparent plastic cover that is secured over a wall mounted motion sensor using screw fasteners and double-sided tape.

Other documents describing the closest subject matter provide for a number of more or less complicated features that fail to solve the problem in an efficient and economical way. None of these patents suggest the novel features of the present invention.

SUMMARY OF THE INVENTION

It is one of the objects of the present invention to provide a protective cover for wall mounted toilet flush sensors that includes screws to fix the protective cover to the sensor and to the external cover.

It is another object of this invention to provide a protective cover for wall mounted toilet flush sensors that includes an adhesive element to help secure the cover to the sensor.

It is another object of this invention to provide a protective cover for wall mounted toilet flush sensors that includes openings aligned to openings on the sensor to ease fixing thereof.

It is still another object of the present invention to provide a protective cover for wall mounted toilet flush sensors that includes a cover having a transparent body to prevent blocking of the sensor functions.

It is yet another object of this invention to provide such a device that is inexpensive to implement and maintain while retaining its effectiveness.

Further objects of the invention will be brought out in the following part of the specification, wherein detailed description is for the purpose of fully disclosing the invention without placing limitations thereon.

BRIEF DESCRIPTION OF THE DRAWINGS

With the above and other related objects in view, the invention consists in the details of construction and combination of parts as will be more fully understood from the following description, when read in conjunction with the accompanying drawings in which.

DETAILED DESCRIPTION OF THE EMBODIMENTS OF THE INVENTION

Figure 1:
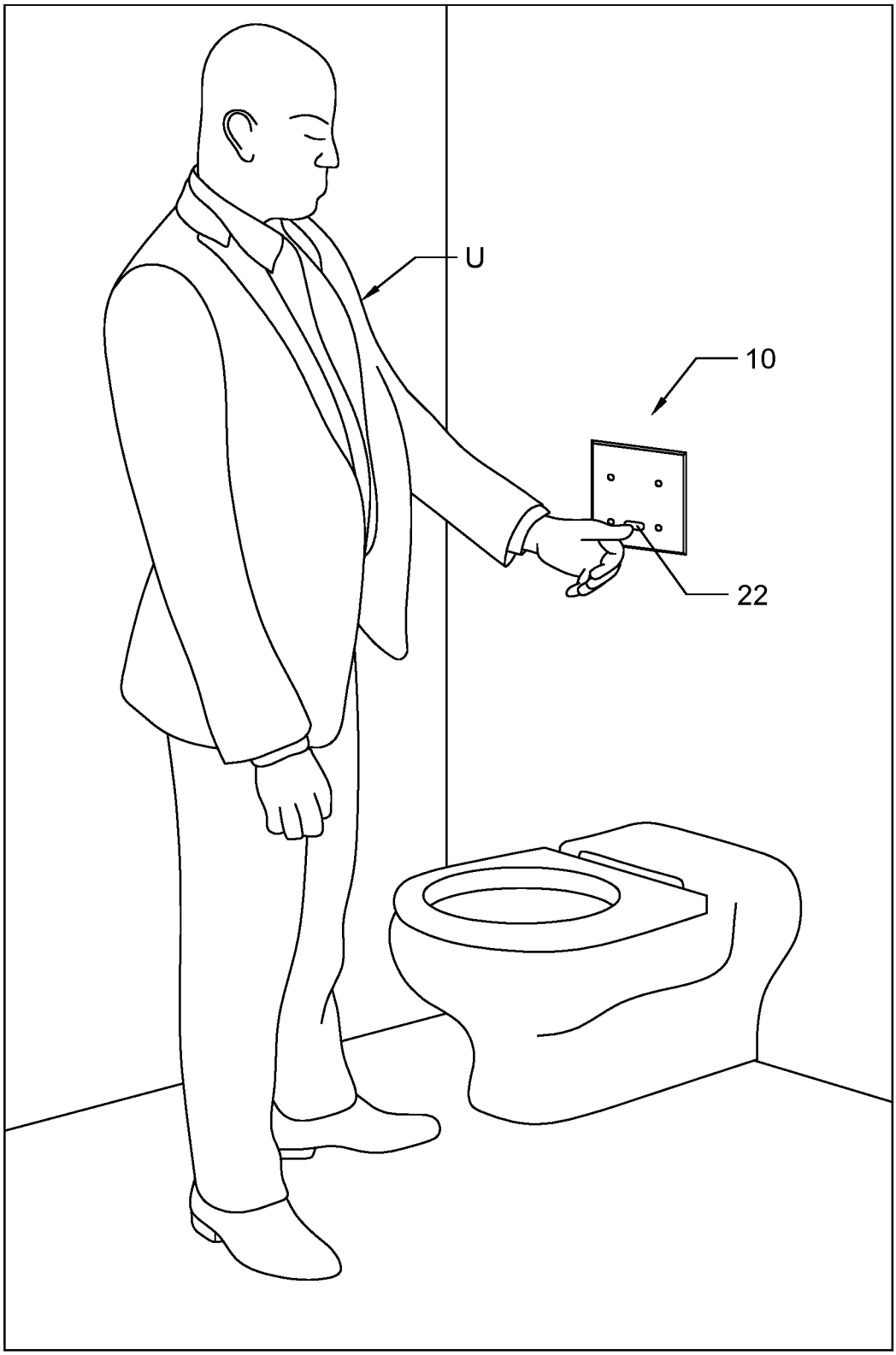
FIG. 1 represents an isometric operational view of the present invention 10 where user U is pressing the sensor protected for the cover 22.
Figure 2:
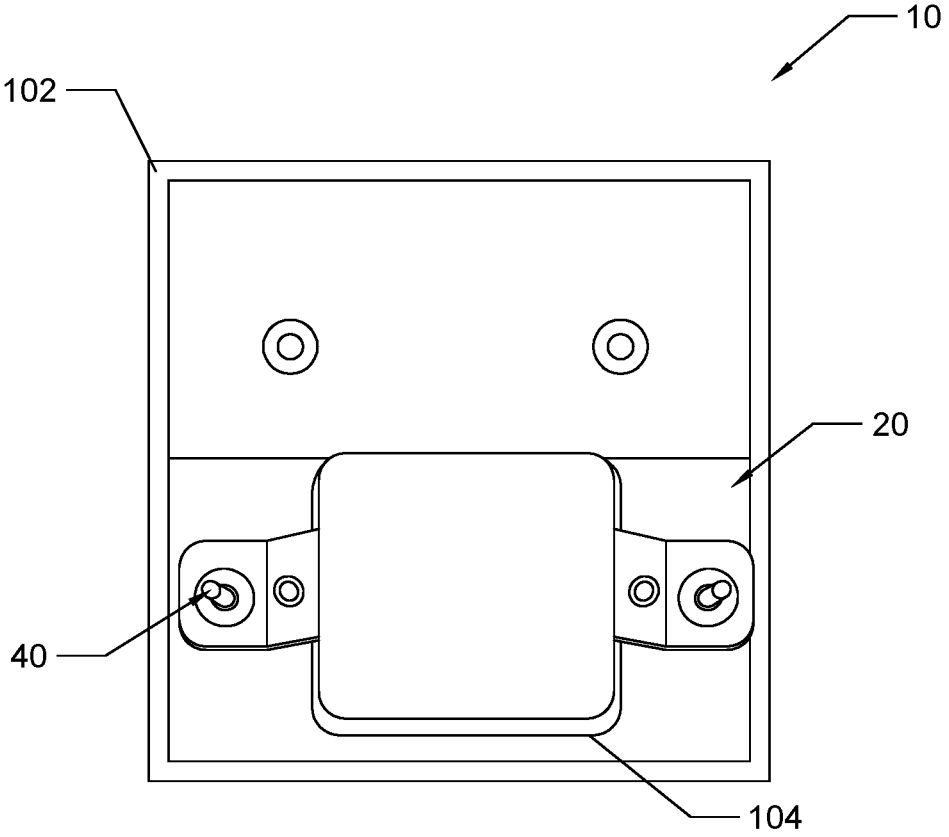
FIG. 2 illustrates a rear perspective view of the present invention 10 in an environment of use.

Referring now to the drawings, where the present invention is generally referred to with numeral 10, it can be observed that it basically includes a cover assembly 20, a fastening assembly 40 and an adhesive assembly 60. It should be understood there are modifications and variations of the invention that are too numerous to be listed but that all fit within the scope of the invention. Also, singular words should be read as plural and vice versa and masculine as feminine and vice versa, where appropriate, and alternative embodiments do not necessarily imply that the two are mutually exclusive.

Figure 3:
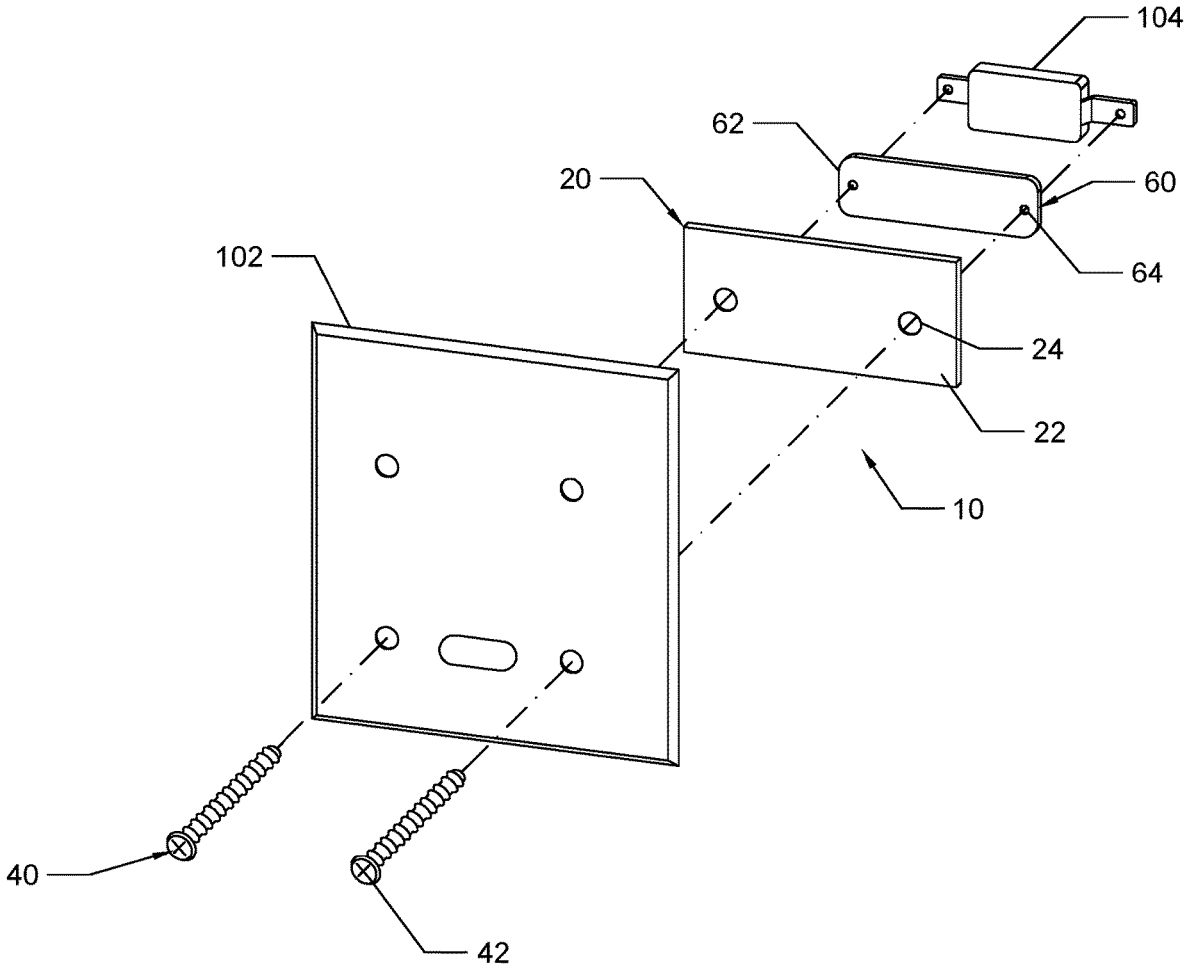
FIG. 3 shows an exploded view of the present invention 10 in an environment of use, the environment of use includes an external cover 102 and a sensor 104. The present invention 10 includes a cover assembly 20, a fastening assembly 40 and an adhesive assembly 60.
Figure 4:
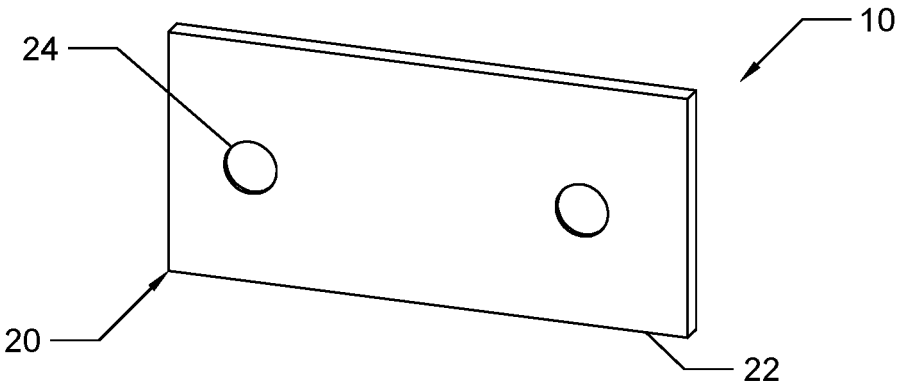
FIG. 4 is a representation of an isometric view of the cover assembly 20.

As best illustrated in FIG. 3 the cover assembly 20 may include a cover 22 and at least two openings 24. In a preferred embodiment the cover 22 may have a rectangular shape. It also may be suitable for the cover 22 to have an oval shape, a circular shape, or any other suitable shape. The cover 22 may be made of Poly(methyl methacrylate). It also may be suitable for the cover 22 to be made of polyvinyl chloride, glass, or any other suitable material. The cover 22 may be transparent. The cover 22 may have such a thickness that allows sensor 104 work as usual. In a preferred embodiment sensor 104 is an infra-red sensor. The cover 22 may be fixed between the external cover 102 and the sensor 104.

The at least two openings 24 may be in a central portion of the cover 22. The at least two openings 24 may go through the cover 22. In a preferred embodiment the at least two openings 24 are circular in shape. It also may be suitable for the at least two openings 24 to have a rectangular shape, an oval shape, or any other suitable shape. The at least two openings 24 may be equidistantly spaced and may conform in position with openings in sensor 104. It should be understood that the at least two openings 24 are adapted to ease attachment of the cover 22 to the sensor 104.

The cover 22 may be adhered to the sensor 104 by means of the adhesive assembly 60. The adhesive assembly 60 may include an adhesive member 62 having openings 64. The adhesive member 62 may be made of a transparent material. The adhesive member 62 may be made of polyethylene, or any other suitable material. The adhesive member 62 may have a front wall and a rear wall. The front wall of the adhesive member 62 and the rear wall of the adhesive member 62 may have an adhesive material impregnated therein. The adhesive material may be an epoxy adhesive, a polyurethane adhesive, a polyamide adhesive, or any other suitable adhesive. In one embodiment the adhesive member 62 may have a rectangular shape with rounded corners. It also may be suitable for the adhesive member 62 to have a circular shape, a triangular shape, or any other suitable shape. Preferably, the adhesive member 62 may conform with the shape of the front wall of sensor 104. Openings 64 may be aligned with the at least two openings 24. In a preferred embodiment the adhesive member 62 may have a smaller thickness than a thickness of the cover 22.

The fastening assembly 40 may include at least two fasteners 42. In a preferred embodiment the at least two fasteners 42 are screws. It also may be suitable for the at least two fasteners 42 to be nuts and bolts, dowels, or any other fastening mean. It should be understood that sensor 104 and external cover 102 may be adapted to receive the at least two fasteners 42 therethrough, as illustrated in FIG. 3. In a preferred embodiment the cover 42 may be fastened between the external cover 102 and the adhesive member 62. The adhesive member 62 may secure fixing of the sensor 104 to the cover 22. The at least two fasteners 42 may go through the external cover 102, the cover 42, the adhesive member 62 and the sensor 44. The at least two fasteners 42 may also be used to attach the external cover 102, the cover 42, the adhesive member 62 and the sensor 44 to a predetermined surface.

Figure 5:
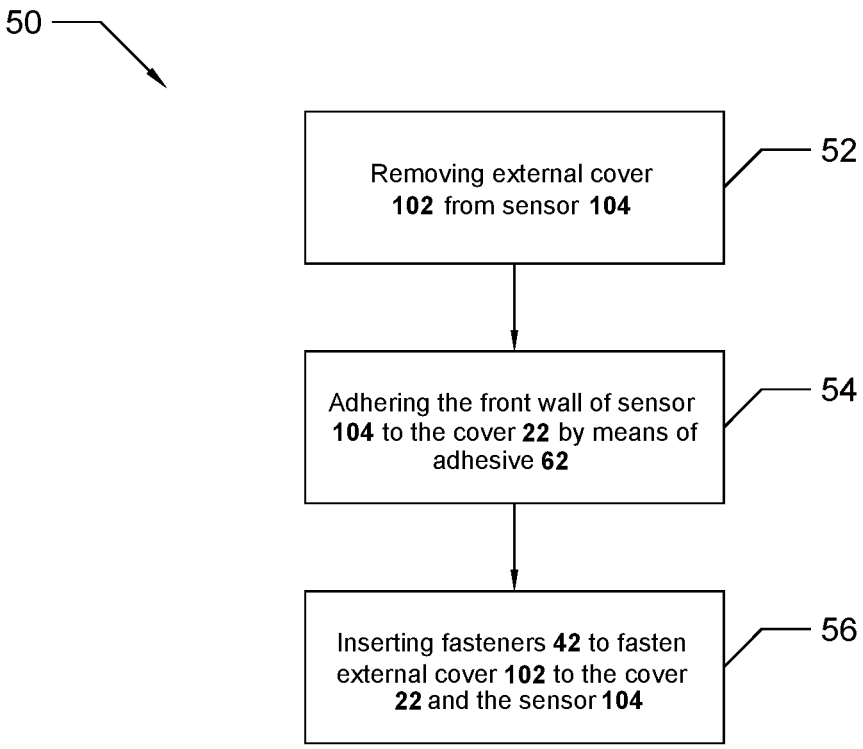
FIG. 5 depicts a schematic of method 50, method 50 is followed for installation of the present invention 10 in the environment of use.

Referring now to FIG. 5 method 50 may include a first step 52, a second step 54 and a third step 56 for installation of cover 22 in the environment of use. The first step 52 may include removing external cover 102 from sensor 104. The external cover 102 and the sensor 104 may be initially attached therebetween and to a predetermined surface such as the wall of a bathroom. The second step 54 may include adhering the front wall of sensor 104 to the cover 22 by means of adhesive 62. The third step 56 may include inserting fasteners 42 to fasten external cover 102 to the cover 22 and to the sensor 104. Sensor 104 is normally depressed leading to a malfunction of the sensor 104. The cover 22 covers the sensor 104 so the sensor 104 can not be depressed.

The foregoing description conveys the best understanding of the objectives and advantages of the present invention. Different embodiments may be made of the inventive concept of this invention. It is to be understood that all matter disclosed herein is to be interpreted merely as illustrative, and not in a limiting sense.

What is claimed is:

1. A protective cover for wall mounted toilet flush sensors, consisting of a cover assembly, wherein said cover assembly includes a cover, said cover having a rectangular shape and at least two openings, said at least two openings are located on a central portion of said cover, said at least two openings have a circular shape and are equidistantly disposed in said cover;

an adhesive assembly, wherein said adhesive assembly includes an adhesive member, said adhesive member is a double-sided tape, wherein said adhesive member adheres said cover to a front wall of a flush sensor, said cover has a thickness greater than a thickness of said adhesive member, wherein said cover and said adhesive member are transparent; and a fastening assembly, wherein said fastening assembly includes at least two fasteners, wherein said at least two fasteners are introduced into said at least two openings to fix said cover between an external cover for said flush sensor and said flush sensor, said flush sensor is an infrared sensor, said external cover has a flush sensor opening, wherein said at least two fasteners are screws.

* * * * *